US005123480A

United States Patent [19]

Dixit

[11] Patent Number: 5,123,480

[45] Date of Patent: Jun. 23, 1992

[54] INTEGRATED HEAT EXCHANGER

[75] Inventor: Vijay B. Dixit, Simsbury, Conn.

[73] Assignee: Riley Stoker Corporation, Worcester, Mass.

[21] Appl. No.: 740,321

[22] Filed: Aug. 5, 1991

[51] Int. Cl.[5] ..... F28C 3/16

[52] U.S. Cl. ..... 165/104.16; 122/4 D; 165/140; 432/83

[58] Field of Search ..... 165/104.16, 140, 140.15, 165/140.18; 122/4 D; 432/83

[56] References Cited

U.S. PATENT DOCUMENTS

| | | | |
|---|---|---|---|
| 2,204,447 | 6/1940 | Samans | 165/140 |
| 3,147,084 | 9/1964 | Franzen et al. | 165/140 |
| 3,763,830 | 10/1973 | Robison et al. | 122/4 D |
| 4,371,033 | 2/1983 | Stendahl | 165/104.18 |

*Primary Examiner*—Albert W. Davis, Jr.
*Attorney, Agent, or Firm*—Mason, Kolehmainen, Rathburn & Wyss

[57] ABSTRACT

An integrated, vertical tube heat exchanger for use with a plurality of heat transfer mediums including fluidized solid particulates and hot gaseous products of combustion includes a plurality of vertically extending spaced apart, tubes for containing water/steam flow in close heat transfer relationship with the walls of the tubes. A unitary and compact containment housing is provided around a bank of said vertical tubes for directing a generally lateral flow of fluidized solid particulates moving through a first heat exchange chamber formed around the exterior surface of lower portions of the tubes. A gas plenum chamber is provided adjacent a first end of the lower heat exchange chamber for directing fluidizing gas into the solid particulates in the chamber. The housing is provided with a dividing wall forming a second heat exchange chamber that is separate from and operationally independent of the first heat exchange chamber. The second chamber utilizes hot products of combustion as a heat exchange medium for giving up heat to the vertically upwardly flowing fluid in the bank tubes.

17 Claims, 2 Drawing Sheets

INTEGRATED HEAT EXCHANGER

RELATED APPLICATION

This application is related to copending United States patent application Ser. No. 07/663,544, filed Mar. 1, 1991.

BACKGROUND OF THE INVENTION

1. Field of the Invention

The present invention relates to heat exchangers generally and, more particularly, to an integrated, compact, vertical tube heat exchanger for use with a plurality of heat exchange mediums including recirculating, fluidized solid particulates as well as heated gases such as hot products of combustion. The vertical tube heat exchanger of the present invention is especially well adapted for use in fluidized bed type steam and generating systems wherein both gaseous products of combustion and recirculating fluidized solids are available as a heat transfer medium for heating water and/or steam in a bank of tubes.

2. Background of the Prior Art

The following U.S. patents disclose steam generating systems and heat exchangers using fluidized bed solids as a heat transfer medium: Nicholson U.S. Pat. No. 2,697,653; Ostendorf U.S. Pat. No. 4,313,398; Campanile et al. U.S. Pat. No. 4,340,400; Klaren U.S. Pat. No. 4,427,053; Strohmeyer, Jr. U.S. Pat. No. 4,454,838; Komakine U.S. Pat. No. 4,499,944; Johnson U.S. Pat. No. 4,539,939; Klaren U.S. Pat. No. 4,567,940 and Brannstrom et al. U.S. Pat. No. 4,655,147.

One of the problems associated with fluidized bed heat exchange devices and systems, stems from the fact that fluidizing air must be introduced into a fluidized bed of solids from a lower or floor level and the temperature differentials between the floor material and the relatively cooler, fluid-filled tubes causes relative motion which must be accommodated without leakage of the solids into the plenum chamber or gas supply duct beneath the floor.

OBJECTS OF THE INVENTION

It is an object of the present invention to provide a new and improved heat exchanger of the character described employing vertical fluid tubes and more particularly an integrated heat exchanger having a plurality of separate heat exchange and independently operable chambers for heating a common fluid in the tubes.

Another object of the present invention is to provide a new and improved integrated heat exchanger utilizing recirculating fluidized solids in one chamber and hot gases in another chamber above for heating fluid passing upwardly in a tube bank projecting between said chambers.

More particularly, it is an object of the present invention to provide a new and improved vertical tube type integrated heat exchanger of the character described having an upper exchange chamber using hot gaseous products of combustion as a heat source and a lower chamber using recirculating fluidized solids as a heat source, for heating a common fluid passing upwardly through a bank of tubes which project upwardly between said upper and lower heat exchange chambers.

More particularly, it is an object of the present invention to provide an integrated heat exchanger of the type described which provides for the passage of a common fluid upwardly through a plurality of separate and independently operable stacked heat exchange chambers in a unitary pass within a compact unitary enclosure.

Still another object of the invention is to provide a compact, highly efficient heat exchanger having separate and independently operable chambers for providing heat to a common fluid.

BRIEF SUMMARY OF THE PRESENT INVENTION

The foregoing and other objects of the present invention are accomplished in a new and improved vertical tube, integrated, compact heat exchanger capable of utilizing both fluidized solid particulates and hot gaseous products of combustion as dual heat exchange mediums for heating fluid such as steam and/or water moving in a single pass via a plurality of vertically extending, spaced apart tubes extending across a wall dividing a containment housing into a plurality of separate and independently operable heat exchange chambers. A lower, or first chamber surrounds a portion of the tubes and contains a flowing bed of recirculating fluidized solid particulates moving in heat exchange relationship with the fluid moving internally through the tubes. A fluidizing gas plenum chamber is provided adjacent the first chamber for supplying gaseous fluid that is injected upwardly into the bed of solids to maintain the solid particulate material in a fluidized condition to facilitate movement of the solids through the heat exchange chamber around the tubes. The housing includes a dividing wall between the first heat exchange chamber and an upper or second separate heat exchange chamber surround another portion of the tubes wherein hot gases such as products of combustion provide additional heat for the upwardly moving, internally flowing fluid in the tubes. The fluidized solid particulates move generally transversely across the first heat exchange chamber while fluidizing gas from the plenum chamber maintains the solids in a fluidized condition around the tubes. In the second or upper chamber, additional heat is provided by hot flue gases or products of combustion also flowing around the tubes in a generally lateral direction. The first and second chambers are divided separate from one another in a common housing and are operationally independent, but provide heat for a common fluid flowing between the chambers in a bank of tubes.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT OF THE PRESENT INVENTION

Figure 1:
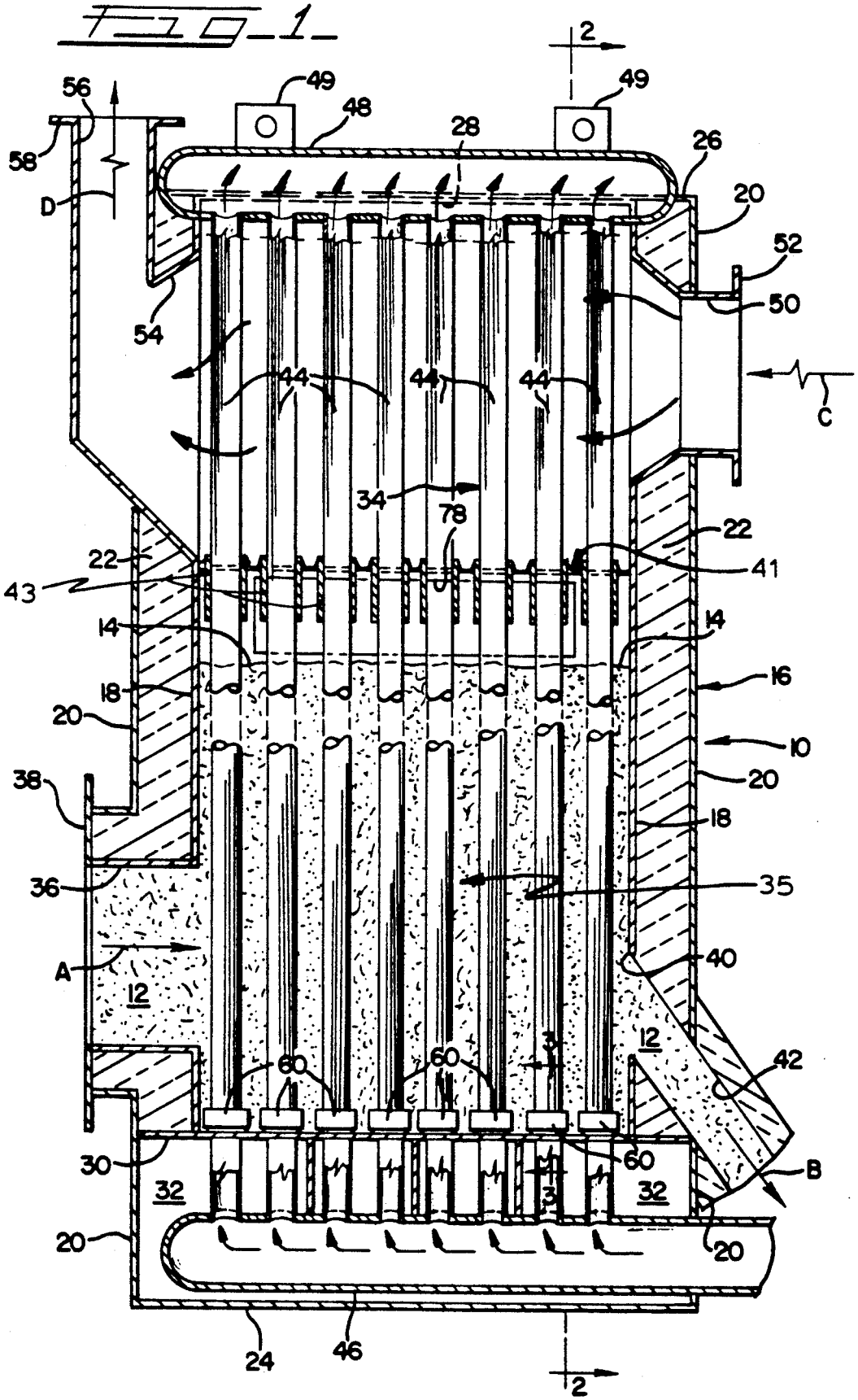
FIG. 1 is a vertical cross-sectional view of a new and improved heat exchanger constructed in accordance with the features of the present invention and adapted to use fluidized solid particulates as a heat transfer medium.

Referring now more particularly to the drawings, therein is illustrated a new and improved vertical tube type, integrated heat exchanger 10 designed to use fluidized solid particulates 12 as a heat transfer medium in a lower fluidized solids, heat exchange chamber in the lower end portion bed, within an upstanding, insulated housing generally indicated by the reference numeral 16. The housing 16 includes pairs of inner and outer vertical side walls 18 and 20, respectively, separated from one another by a space containing high quality, heat insulating material 22.

Figure 2:
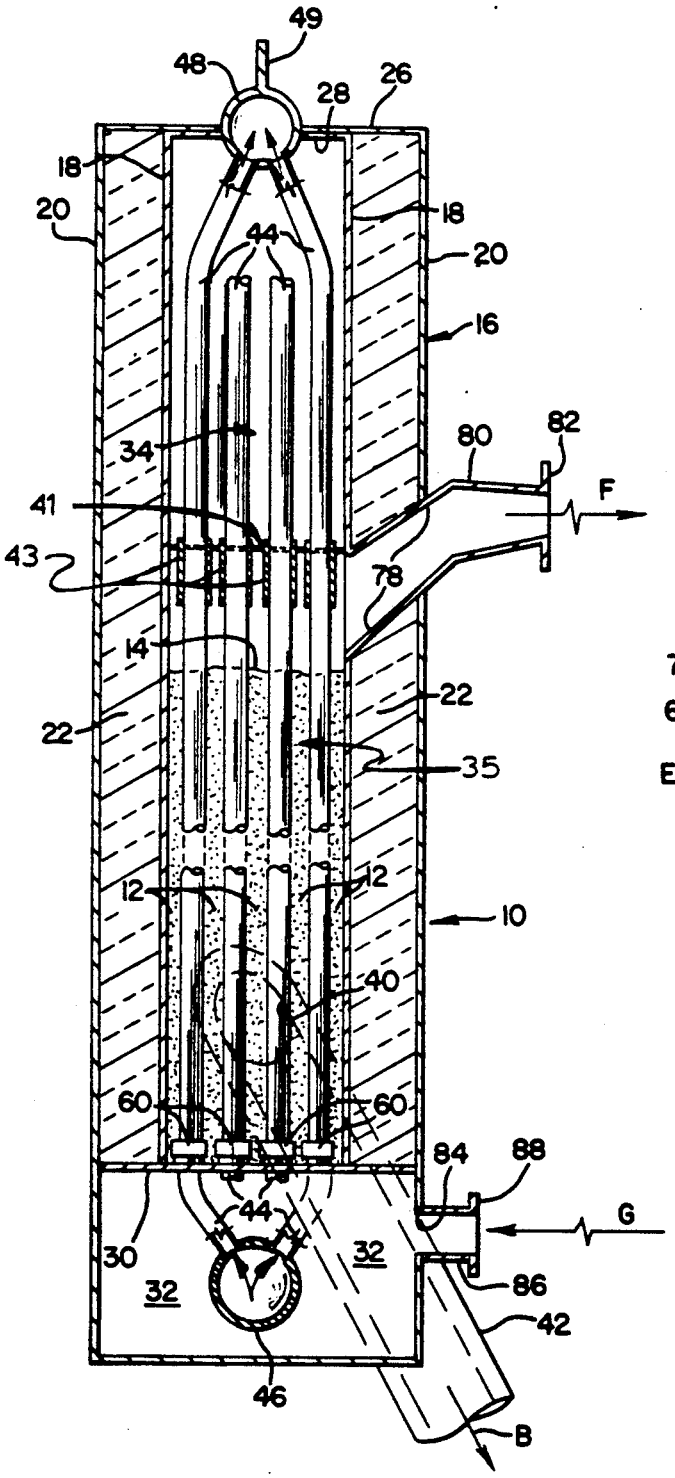
FIG. 2 is a transverse cross-sectional view of the heat exchanger taken substantially along lines 2—2 of FIG. 1.

At the lower end, the housing 16 is provided with a bottom wall 24 and at the upper end a top wall 26 is joined to the outer side walls 20. As best shown in FIG. 2, upper ends of the inner side walls 18 are joined to an inner top wall 28 and at an intermediate level above the bottom wall 24, the housing 16 is provided with a lower, inner wall 30 which forms in the lower interior of the housing 16 a gas plenum chamber 32 for supplying fluidizing gas to a lower, high temperature, heat exchange chamber 35. The lower heat exchange chamber 35 contains a quantity of high temperature, recirculating fluidized solids bed 14 in a lower section of the heat exchanger 10 above the wall 30 on the top of the plenum chamber 32.

As viewed in FIG. 1, a flow of recirculating, high temperature solid particulates 12 is introduced into the lower heat exchange chamber 35 through an inlet opening 36 having an outer flange 38 and adapted to contain a flow of solid particulates that are fluidized and moving from left to right as indicated by the arrow "A". On an opposite side, the housing 16 is provided with a discharge or outlet opening 40 and an insulated outlet discharge duct 42 is connected to the outlet opening 40 to contain an outward and downward flow of cooled solid particulates 12 as indicated by the arrow "B" (FIG. 1).

In accordance with the present invention, the vertical tube heat exchanger 10 is provided with a bank of vertically extending, closely spaced apart, fluid containing tubes 44 for gas and/or liquid such as steam and water that is to be heated. This fluid moves upwardly in the tubes from an elongated, lower supply header 46 mounted in the plenum chamber 32. Upper ends of the tubes 44 are connected to an upper header tank 48 provided at the center of the top walls 26 and 28 of the housing 16 as best shown in FIG. 2.

The header tank 48 includes a pair of centrally aligned, upstanding support brackets 49 which can be used for hanging the entire heat exchanger 10 from a structural member (not shown). The brackets 49 support the upper header tank 48, lower header 46 and the bank of tubes 44 independently of lower portions of the housing 16 and other components in the lower end portion therein. Water, steam and/or a mixture thereof enters into the system through the lower supply header 46 and passes upwardly through the spaced apart fluid tubes 44 for heat absorption through the tube walls. The heated fluid from the tubes 44 eventually moves into the upper collection header 48 for distribution to other components remote therefrom. As the internal fluid moves upwardly in the tubes 44 it is in an efficient heat transfer relationship with the wall surfaces of the tubes which are surrounded by the recirculating solids 12. Thus, heat is picked up from the hot fluidized solids around the outside of the tubes 44 in the lower heat exchange chamber 35 and raises the temperature or enthalpy of the water, steam and/or mixture thereof in the tubes.

In accordance with the present invention, heat may be extracted from the fluid flowing in tubes 44 or further heating of this fluid taking place in a separate and independently operable heat exchange chamber 34 which is spaced above the lower chambers 35. The upper chamber 34 utilizes a separate heat transfer media such as combustion flue gas flowing around the upper portion of the tubes 44 and an inlet fitting 50 having a flange on the outer end is provided on the right hand side wall structure as viewed in FIG. 1 to accommodate the inward flow of gaseous fluids as indicated by the arrow "C". This gaseous fluid flows across the bank of tubes 44 and, depending upon the relative temperatures, may pick up or discharge heat to the inner fluids flowing in the interior of the tubes 44. Eventually, the gases entering the upper portion of the heat exchange chamber 34 pass outwardly of the housing 16 through an outlet opening 54 on the left hand wall structure 18 (as viewed in FIG. 1). This gas eventually flows out of the housing 16 in a direction via an outlet fitting 56 having a flange 58 at the upper end (as indicated by the arrow "D").

The upper and lower heat exchange chambers 34 and 35 surround a common bank of vertical tubes 44 and heat transfer is effected between the heat exchange mediums flowing generally laterally through the respective chambers and the common internal fluid contained inside the tubes. The upper and lower chambers 34 and 35 are sealed from one another by a horizontal divider wall 41 in which are mounted a plurality of thermal sleeves 43 arranged in a matrix pattern so that a tube 44 passes upwardly in each sleeve between the respective heat exchange chambers. The thermal sleeves 43 are positively secured to the divider wall 41 by welding or the like and have an inside diameter (ID) approximately the same as or slightly greater than the outside diameter (OD) of the tubes 44. The tubes 44 and surrounding sleeves 43 form a pressure seal between the chambers 34 and 35 so that each chamber may be operated at a pressure different or the same as the other without affecting the other. The tubes 44 are longitudinally movable relative to the sleeves 43 in order to accommodate differential thermal expansion and contraction while still maintaining an adequate pressure seal between the chambers 34 and 35.

Figure 3:
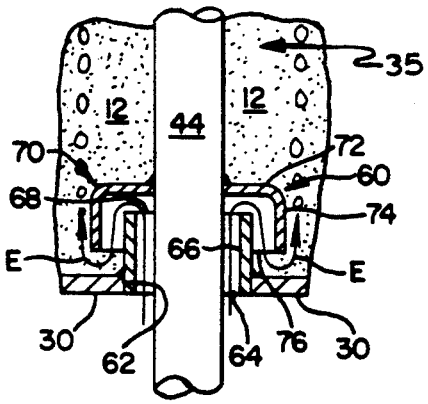
FIG. 3 is an enlarged fragmentary vertical cross-sectional view taken substantially along lines 3—3 of FIG. 1.

In accordance with the present invention, each of the fluid tubes 44 is provided with a bubble cap assembly 60 in concentric alignment with and at a level adjacent the housing divider wall or floor 30. The bubble cap assemblies 60 serve to provide fluidizing gas from the lower plenum chamber 32 to be injected upwardly into the bed 14 of fluidized solid particulates 12 contained in the lower portion of the lower heat exchange chamber 35. As best shown in FIG. 3, the floor or dividing wall 30 which separates the plenum chamber 3 from the heat exchange chamber 34 is formed with a plurality of circular openings 62 concentrically disposed with a vertical tube 44.

As illustrated in FIG. 3, the circular openings 62 are somewhat larger in diameter than the outer diameter (O.D.) of the tubes 44 in order to form an annular air passage 64 around each tube for the injection of gas from the plenum chamber 32 upwardly into the solids bed 14 as illustrated by the arrows "E". In order to prevent solid particulates 12 in the bed 14 from passing downwardly into the plenum chamber 32 at any time and when the plenum chamber is depressurized and not supplied with fluidizing gas, each opening 62 is provided with an upstanding inner cylindrical tube section 66 secured to the floor 30 by welding or the like and terminating at an upper level 68 spaced downwardly of the underside of a radial, upper wall 72 of a bubble cap 70. The annular upper wall 72 is secured to the tube 44 by welding or other means and extends radially outward thereof at a level spaced above the upper end 68 of the inner tube member 66.

The bubble cap also includes a downwardly depending, outer skirt wall 74. Preferably the outer skirt wall 74 and the radial wall 72 of the bubble cap 70 are integrally joined in one piece as illustrated in FIG. 3. The outer skirt wall has a lower end 76 spaced at a level well below the upper end 68 of the inner tube 66 so as to provide a tortuous path for the injection gas moving upwardly as indicated by the arrow "E". In addition, the lower edge 76 of the outer annular skirt 74 provides a dam, which in cooperation with the inner tube member 66 prevents solid particulates 12 from flowing into the plenum chamber 32 around each tube 44 through the openings 62, especially when injection gas is not present during periods of shutdown or the like. Normally, during operation, the presence of high velocity fluidizing gas in the bubble caps 60 helps to prevent the downward flow of any of the solid particulates 12 into the plenum chamber 32.

Injected fluidizing gas from the lower plenum chamber 32 moves upwardly around the individual tubes 44 and fluidizes the solid particulates 12 so that they can float or slide and move laterally or horizontally around the tubes to transfer heat to the steam and/or water flowing upwardly in the interior of the tubes. Because the tubes 44 are normally cooled from the interior by the water and/or steam moving therethrough, a considerably lower temperature is normally obtained in the metal of the tubes 44 than is present in the surrounding walls 18 and divider wall or floor 30 of the heat exchanger 10.

The differential in temperature between the tubes 44 and the floor 30 and walls 18 varies between high operating ranges and low operating ranges and these differences tend to cause great divergence in the amount of relative contraction and expansion between the tubes 44 and the floor 30. If the tubes 44 were welded to the floor 30, stresses would tend to build up because of differential thermal expansion and contraction during operation and during periods of shut down. However, these stresses do not develop because the bubble caps 60 permit the tubes 44 to float relative to the openings 62 in the floor 30 and the surrounding walls 18 of the housing 16 so that few, if any, relative expansion and contraction stresses are built up between these components because of differential thermal expansion and contraction. The tubes 44 are also longitudinally slidable relative to the sleeves 43 fixed in the divider wall 41 and this arrangement also precludes stress buildup in the unitary tubes 44 which extend between the chambers 34 and 35.

The bubble caps 60 thus provide a dual function of injecting fluidizing gas while preventing a reverse flow of solid particulates 12 and also provide a means for accommodating differential expansion and contraction between the normally cooler, elongated fluid containing vertical tubes 44 and the hot floor 30 at the regions where the tubes pass through the openings 62 in the floor 30.

At a level above the solids bed 14, the side walls 18 and 20 on at least one side of the housing 16 are provided with a rectangular discharge opening 78 so that fluidizing gas reaching the upper level of the solids bed 14 can pass readily out of the housing 16 through a separate fluidizing gas outlet duct 80 having a flange 82 at the outer end as indicated by the arrow "F" in FIG. 2.

Initially, fluidizing gas such as air is supplied to the plenum chamber 32 through an inlet opening 84 and inlet duct 86 having a flange 88 at the outer end as indicated by the arrow "G", FIG. 2. Generally, the fluidizing gas is under pressure from a fan or blower (not shown) so that when the heat exchanger 10 is in operation, the plenum chamber 32 is pressurized.

Typically, the heat exchanger 10 may be utilized in fluidized bed type combustion systems such as those shown and described in U.S. Pat. Nos. 4,745,884; 4,708,662; 4,709,663.

In a typical operation example, recirculating fluidized solid particulates 12 are introduced into the lower chamber 35 at a temperature range of 1550° F.-750° F. Internal fluid such as water and steam is introduced into the lower end of the bank of tubes 44 at a typical temperature range of 300° F.-400° F. less than the incoming solids flow. Solids leaving the chamber 35 through the outlet opening 40 and discharge chute 42 may have a temperature range of 900° F.-1400° F.

In the upper heat exchange chamber 34, hot products of combustion in a temperature range of 1550° F.-1750° F. are introduced via the inlet opening 50 and after giving up heat to the upwardly moving internal fluid in the bank of tubes the gases leave the chamber 34 via the outlet 54 at a temperature ranging from 800° F.-900° F.

Typically, hot product of combustion gases contain some solids (usually less than 5%) and flow into the chamber 34 at velocities in the range of 40-50 feet per second. Such gas may include 5-6% oxygen, 75% nitrogen, 10% water vapor, 10-12% carbon dioxide, 300 parts per million (PPM) of sulphur dioxide, 100 PPM or less carbon monoxide and less than 200 PPM of nitrous oxides or NoX.

The flow of the gaseous heat exchange medium in the upper chamber 34 is generally in a direction opposite to the flow of the fluidized solid particulates in the lower chamber 35 and this arrangement provides excellent efficiency in heat transfer.

The heat exchanger 10 provides a dual capability of two separate and operationally independent heat exchangers within a unitary and compact housing 16 and each heat exchanger chamber 34 and 35 may be operated on different parameters than the other although a common fluid flows internally through the tubes 44.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A heat exchanger integrated for use with a plurality of separate heat transfer mediums in heat transferring relationship with a common fluid, comprising:

a plurality of elongated spaced apart tubes forming a tube bank for internally containing a flow of said common fluid;

a housing around said tube bank divided to include a plurality of separate heat exchange chambers, a first of said chambers adapted for containing a first heat exchange medium comprising a mass of fluidized solid particulates moving around a first portion of said tube bank and a second heat exchange chamber adapted for containing a flow of a second heat exchange medium around a second portion of said tube bank, said housing being divided between said first and second heat exchange chambers by wall means including a plurality of hollow sleeves mounted therein for accommodating said tubes passing through said sleeves;

a gas plenum chamber adjacent said first chamber in communication therewith through openings around said tubes for injecting fluidizing gas into said first heat exchange medium; and means around said tubes for preventing said first heat exchange medium from said first chamber from passing into said plenum chamber.

2. The heat exchanger of claim 1, wherein:

said tubes extend transversely of said wall means in coaxial alignment with said sleeves.

3. The heat exchanger of claim 2, wherein:

said tubes have an outside diameter equal to or slightly less than the inside diameter of said sleeves for permitting relative longitudinal movement.

4. The heat exchanger of claim 3, wherein:

said tubes extend from said first heat exchanger into said gas plenum chamber.

5. The heat exchanger of claim 1, wherein:

said first chamber includes inlet and outlet means for passing said fluidized solid particulates generally transversely across said first portion of said tube bank.

6. The heat exchanger of claim 5, wherein:

said first chamber includes gas outlet means for said fluidizing gas spaced apart from said gas plenum.

7. The heat exchanger of claim 6, wherein:

said gas outlet means is positioned at a level above said inlet and outlet means for said fluidized solid particulates.

8. The heat exchanger of claim 5, wherein:

said second chamber includes inlet and outlet means for passing said second heat exchange medium generally transversely across said second portion of said tube bank.

9. The heat exchanger of claim 8, wherein:

said inlet and outlet means in said second chamber are positioned to direct said second heat exchange medium in a direction generally opposite to the direction of said first heat exchange medium across said tube bank.

10. An integrated heat exchanger for use with a plurality of separate heat exchange mediums for heat transfer relationship with a common fluid, comprising:

a plurality of elongated tubes arranged in a spaced apart array forming a tube bank with tube runs extending between inlet and outlet headers at opposite ends of said tubes;

a first heat exchange chamber formed around said tube bank adjacent one end of said tube runs;

a second exchange chamber formed around said tube bank adjacent an opposite end of said tube runs;

wall means intermediate said first and second heat exchange chambers for separating and sealing around said tubes between said chambers, said wall means including a plurality of pressure sleeves mounted thereon, each in concentric alignment with a tube of said tube bank passing between said first and second chambers;

first means for directing a flow of a first heat exchange medium across said tube bank in said first heat exchange chamber;

second means for directing a flow of second heat exchange medium across said tube bank in said second heat exchange chamber; and a gas plenum chamber for directing a flow of fluidizing gas into at least one of said chambers for fluidizing the heat exchange medium therein.

11. The heat exchanger of claim 10, wherein:

one of said inlet and outlet headers is mounted in said gas plenum chamber.

12. The heat exchanger of claim 10, wherein:

said pressure sleeves comprise elongated hollow elements having an inside diameter substantially equal to or slightly larger than the outside diameter of said tubes, which tubes are slidable longitudinally relative to respective surrounding sleeves.

13. The heat exchanger of claim 12, wherein:

said sleeves are fixedly secured to said wall means.

14. The heat exchanger of claim 10, wherein:

one of said inlet and outlet headers is fixedly mounted in one of said heat exchange chambers and the other of said inlet and outlet headers is movably mounted in said gas plenum chamber.

15. The heat exchanger of claim 14, wherein said fixedly mounted header supports said tube bank depending downwardly thereof.

16. The heat exchanger of claim 10, wherein:

said first and second heat exchange chambers are operated at different pressures.

17. The heat exchanger of claim 16, wherein:

at least one of said heat exchanger chambers includes a separate outlet for fluidizing gas.

* * * * *